US006233398B1

(12) United States Patent
Rutherford et al.

(10) Patent No.: US 6,233,398 B1
(45) Date of Patent: May 15, 2001

(54) HEATING ELEMENT SUITABLE FOR PRECONDITIONING PRINT MEDIA

(75) Inventors: James M. Rutherford, Dresbach, MN (US); Charles J. Eckman, Dallas, PA (US); Theodore Von Arx, La Crescent, MN (US)

(73) Assignees: Watlow Polymer Technologies, Winona, MN (US); Rheem Manufacturing Co., New York, NY (US)

( * ) Notice: Subject to any disclaimer, the term of this patent is extended or adjusted under 35 U.S.C. 154(b) by 0 days.

(21) Appl. No.: 09/275,161

(22) Filed: Mar. 24, 1999

Related U.S. Application Data

(63) Continuation-in-part of application No. 08/767,156, filed on Dec. 16, 1996, which is a continuation-in-part of application No. 08/365,920, filed on Dec. 29, 1994, now Pat. No. 5,586,214.

(51) Int. Cl.[7] ..... H05B 3/40; H05B 3/44
(52) U.S. Cl. ..... 392/503; 219/216; 219/544
(58) Field of Search ..... 219/544, 546, 219/548, 549, 216; 392/432, 434, 503

(56) References Cited

U.S. PATENT DOCUMENTS

| | | | | |
|---|---|---|---|---|
| 1,043,922 | | 11/1912 | Gold | 219/523 |
| 2,146,402 | | 2/1939 | Morgan | 219/523 |
| 2,889,439 | * | 6/1959 | Musgrave | 219/345 |
| 3,268,846 | * | 8/1966 | Morey | 219/549 |
| 3,614,386 | | 10/1971 | Hepplewhite | 219/312 |
| 3,621,566 | | 11/1971 | Welsh | 29/610 |
| 3,683,361 | | 8/1972 | Salzwedel | 338/322 |
| 3,860,787 | | 1/1975 | Strobach | 219/336 |
| 3,927,300 | | 12/1975 | Wada et al. | 219/381 |

(List continued on next page.)

FOREIGN PATENT DOCUMENTS

| | | |
|---|---|---|
| 35 12 659 | 9/1986 | (DE) . |
| 3512659 | 10/1986 | (DE) . |
| 38 36 387 C1 | 5/1990 | (DE) . |
| 14562 | 9/1913 | (GB) . |
| 1070849 | 6/1967 | (GB) . |
| 2244898 | 12/1991 | (GB) . |
| 53-134245 | 11/1978 | (JP) . |
| 3-129694 | 6/1991 | (JP) . |

OTHER PUBLICATIONS

"Polymers", *Guide to Selecting Engineered Materials*, a special issue of *Advanced Materials & Processes*, Metals Park, OH, ASM International, 1989, pp. 92–93.

"Makroblend Polycarbonate Blend, Tedur Polyphenylene Sulfide", *Machine Design: Basics of Design Engineering*, Cleveland, OH, Penton Publishing, Inc., Jun. 1991, pp. 820–821, 863, 866–867.

Patent Abstracts of Japan, V.095, No. 011, Dec. 26, 1995.

JP 07 211438A Micro Jienitsukusu KK, Aug. 11, 1995, abstract.

European Search Report, Ruly 13, 1998.

"At HEI, Engineering is our Middle Name", Heaters Engineering, Inc., Mar. 2, 1995.

*Primary Examiner*—Teresa Walberg
*Assistant Examiner*—Thor Campbell
(74) *Attorney, Agent, or Firm*—Duane Morris & Heckscher LLP

(57) ABSTRACT

Heating elements suitable for heating a printing media of a ink-jet printer are provided. The heating element includes an electrical resistance heating member for generating resistance heating and a polymeric supporting layer for substantially encapsulating the electrical resistance heating member. The heating elements of this invention can include a fibrous support layer disposed over the electrical resistance heating member for assisting in the application of the polymeric layer. Additionally, the provided heating elements can be formed into a portion of a media pathway for an ink-jet printer.

21 Claims, 2 Drawing Sheets

U.S. PATENT DOCUMENTS

| | | | | |
|---|---|---|---|---|
| 3,943,328 | | 3/1976 | Cunningham | 219/335 |
| 3,952,182 | | 4/1976 | Flanders | 219/309 |
| 4,272,673 | | 6/1981 | Semanaz et al. | 219/544 |
| 4,326,121 | | 4/1982 | Welsby et al. | 219/523 |
| 4,354,096 | | 10/1982 | Dumas | 219/523 |
| 4,436,988 | | 3/1984 | Blumenkranz | 219/544 |
| 4,687,905 | | 8/1987 | Cunningham et al. | 219/336 |
| 4,707,590 | | 11/1987 | Lefebvre | 219/523 |
| 4,751,528 | | 6/1988 | Spehrley, Jr. et al. | 346/140 |
| 4,860,434 | * | 8/1989 | Louison et al. | 29/611 |
| 4,970,528 | | 11/1990 | Beaufort et al. | 346/25 |
| 5,013,890 | | 5/1991 | Gamble | 392/497 |
| 5,021,805 | | 6/1991 | Imaizumi et al. | 346/76 R |
| 5,041,846 | | 8/1991 | Vincent et al. | 346/25 |
| 5,129,033 | | 7/1992 | Ferrara et al. | 392/447 |
| 5,155,800 | | 10/1992 | Rezabek et al. | 382/503 |
| 5,287,123 | | 2/1994 | Medin et al. | 346/140 R |
| 5,406,316 | | 4/1995 | Schwiebert et al. | 347/18 |
| 5,406,321 | * | 4/1995 | Schwiebert et al. | 347/102 |
| 5,461,408 | | 10/1995 | Giles et al. | 347/102 |
| 5,500,667 | | 3/1996 | Schwiebert et al. | 347/102 |
| 5,572,290 | | 11/1996 | Ueno et al. | 399/329 |
| 5,581,289 | | 12/1996 | Firl et al. | 347/104 |
| 5,619,240 | | 4/1997 | Pong et al. | 347/103 |
| 5,625,398 | | 4/1997 | Milkovits et al. | 347/104 |
| 5,633,668 | | 5/1997 | Schwiebert et al. | 347/102 |
| 5,691,756 | | 11/1997 | Rise et al. | 347/102 |
| 5,835,679 | | 11/1998 | Eckman et al. | 392/503 |
| 5,856,650 | | 1/1999 | Rise et al. | 219/216 |

* cited by examiner

HEATING ELEMENT SUITABLE FOR PRECONDITIONING PRINT MEDIA

CROSS REFERENCE TO RELATED APPLICATIONS

This application is a continuation-in-part application of U.S. patent application Ser. No. 08/767,156 filed Dec. 16, 1996, which, in turn, is a continuation-in-part of U.S. patent application Ser. No. 08/365,920 filed Dec. 29, 1994, now U.S. Pat. No. 5,586,214, said applications are hereby incorporated by reference.

FIELD OF THE INVENTION

This invention relates to electrical resistance heating elements, and more particularly, to polymer-based resistance heating elements for preconditioning print media for better printing resolution.

BACKGROUND OF THE INVENTION

Thermal ink-jet printers are fast and durable and are known to produce high definition color printouts easily and cost effectively. A typical thermal ink-jet printer is disclosed in U.S. Pat. No. 4,728,963, assigned to Hewlett-Packard Company, Palo Alto, Calif.

The '963 patent discloses an inkjet printer employing a plurality of resister elements to expel droplets of ink to a plurality of nozzles. Upon energizing a particular resister element, a droplet of ink is expelled through a process of vaporization through the nozzle toward the print medium, such as paper, fabric or plastic film. The firing of ink droplets can be microprocessor controlled. As the ink cartridge containing the nozzles is moved repeatedly across the width of the medium to be printed, each of the nozzles is caused to eject ink or refrain from ejecting ink according to the instructions provided by the microprocessor. In order to obtain multi-colored printed images, a plurality of ink-jet cartridges are used, each having a chamber holding a different color ink.

Ink-jet printers are known to have two common deficiencies associated with ink saturation into a porous media, such a paper. The first is that the often liquid inks absorb into the cellulosic fibers of the paper, causing them to swell. This generates unacceptably wavy or "cockled" formations in the ordinarily flat paper media. "Paper cockle" can cause a degradation of print quality due to uncontrolled spacing between the pen and paper, and can sometimes cause the paper to come in contact with the print head, which results in a low quality images and print. The second problem is that adjacent colors of colored ink-jet print tend to run or bleed into one another, causing a reduction in resolution and clarity of the final image.

Heating elements have been proposed for drying the ink rapidly after it has been printed. This has helped to reduce smearing, but has only limited effectiveness in reducing paper cockle or ink migration that occurs during printing, and in the first few fractions of a second after printing.

One solution provided by U.S. Pat. Nos. 5,406,321 and 5,633,668, also assigned to Hewlett-Packard Company, and hereby incorporated by reference, includes a preconditioning preheater disposed along the medium path for heating the medium before it reaches the print area. The preheater of the '321 patent includes a thin heating surface, such as a thin flexible film having a large area suspended in air by a support structure. The preheater has very low thermal mass so as to avoid long warmup intervals, and is supported by securing one edge of the preheater film along the print area with spring tensioners for keeping the film taut. The film is designed to assume a curved edge support, while suspending most of the area of the preheater in air.

While thin film heating elements are known to effectively precondition paper for ink-jet printers, such members represent an additional component of a thermal ink-jet heater, adding to its overall cost. Moreover, thin film heating elements can very easily be dislodged or damaged during heavy use, and may unintentionally cause temporary or permanent thermal damage to the often polymeric medium path immediately adjacent to the print area.

Accordingly, there remains a need for a heating element for preconditioning print media which is more cost effective, and which does not present a possible obstacle in the media pathway or cause thermal distortion of polymeric printer components during use.

SUMMARY OF THE INVENTION

This invention provides heating elements and attendant methods, for preheating a printing media for an ink-jet printer. The heating elements of this invention include an electrical resistance heating member for generating resistance heating when electrically activated and an optional fibrous support layer disposed over said electrical resistance heating member. The resistance heating member and fibrous support layer are encapsulated within a polymeric layer which is resistant to thermal deformation and melting at temperatures ranging from 80–150° C.

The heating elements of this invention are cost effective since they can be made to be integral with the media pathway itself, either as part of the overall molded construction of the printer mid-frame assembly, carriage or paper tray, for example, or melt-bonded, cross-linked, or adhered to the surface of the media pathway after the media pathway is molded. The polymeric layer of the heating elements of this invention can be made of the same polymer as the overall housing of the printer, or a temperature-resistant polymer which has the same, or similar coefficient of thermal expansion as the polymer resin of the media pathway so as to avoid warping or thermal deformation of the pathway proximate to the print area. They are designed to provide heating to the media by direct contact, or radiant or convective heating.

The integrally formed heating element of this invention can reduce a number of components in a thermal ink-jet printer, so as to minimize cost of the overall device, while simultaneously eliminating the problems associated with expensive quartz heaters, or flimsy film heaters which normally require tensioning means and careful handling of the media. The heating elements can be "multipurpose" in that they can provide structural support and preconditioning for the media at the same time.

This invention also provides a heating element for preconditioning a printed medium which includes an electrical resistance heating wire forming a serpentine circuit, a first glass mat disposed on a top surface of said resistance heating wire, and a second glass mat support layer located on a bottom surface of said resistance heating wire. The resistance heating wire and first and second glass mat supporting layers are then disposed within a substantially encapsulating, high temperature, polymeric resin, whereby the first and second glass mat supporting layers provide mechanical support for the electric resistance heating wire during the application of the resin, such as by compression molding.

BRIEF DESCRIPTION OF THE DRAWINGS

The accompanying drawings illustrate preferred embodiments of the invention as well as other information pertinent to the disclosure, in which.

DETAILED DESCRIPTION OF THE INVENTION

The present invention provides heating elements useful as pre-heaters for ink jet printers, and the like. As used herein, the following terms are defined:

"Printing Media" means any suitable media for print, including paper, transparencies, glossy media, whether they be cellulosic or polymeric in nature;

"Ink-Jet Printer" means any one of a number of printers employing a plurality of resister elements to expel droplets of ink through a plurality of nozzles, whether the ink is liquid or solid form;

"Substantially Encapsulating" means that at least 85% of the surface area of the designated member is provided with polymeric material, but does not necessarily mean that the coating is hermetic;

"Serpentine Path" means a path which has one or more curves for increasing the amount of electrical resistance material in a given volume of polymeric matrix, for example, for controlling the thermal expansion of the element;

"Melting Temperature" means the point at which a polymeric substance begins to liquefy;

"Degradation Temperature" means the temperature at which a thermoplastic or thermosetting resin begins to lose its mechanical or physical properties because of thermal damage;

"Media Pathway" means the route that a printing media takes through a printer; and "Melt Bond" means the bond between two members integrally joined, whereby the atoms or molecules of one member mixes with the atoms or molecules of the other.

Heating Element Construction

Figure 1:
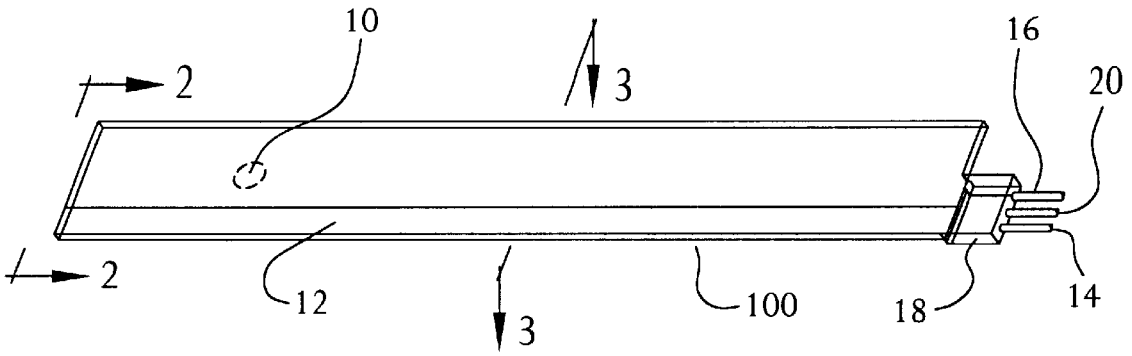
FIG. 1: is a front perspective view of a preferred heating element suitable for preconditioning print media of this invention.
Figure 2:
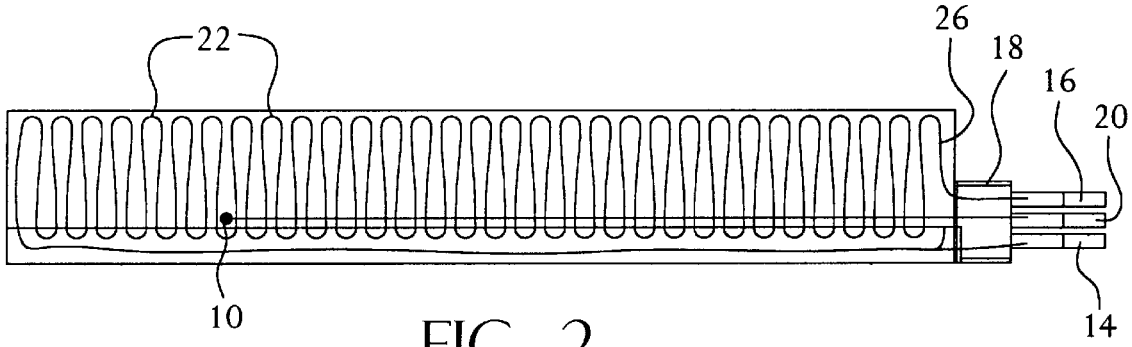
FIG. 2: is a top plan, cross-sectional view of the heating element of FIG. 1, taken through line 2—2, illustrating a preferred circuit.
Figure 3:
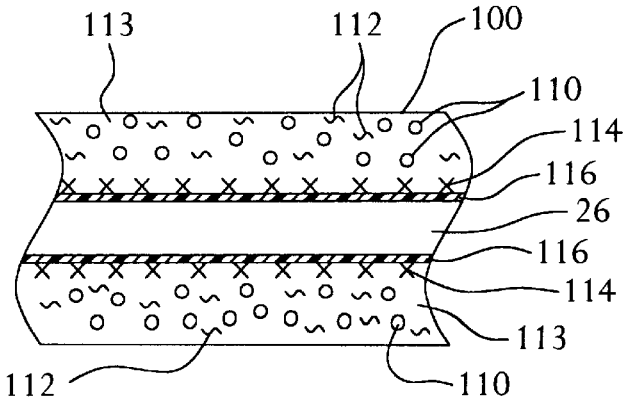
FIG. 3: is a partial cross-sectional view of the heating element of FIG. 1, taken to line 3—3 of FIG. 1, showing a preferred arrangement of materials.

With reference to the Figures, and particularly FIGS. 1–3 thereof, there is shown a preferred heating element 100 having dimensions of about 22.2 cm in length, 3.56 cm in width, and 0.25 cm in thickness, with a preferred lead coupler 18 protruding about 1.3 cm from one end. The heating element 100 includes a regulating device for controlling electric current. More preferably, this device is either a thermistor, or a thermocouple 10, for preventing overheating of the polymeric materials and printing media.

When adhered to the surface of a media pathway, the heating elements 100 of this invention can include a tapered leading edge 12 for directing printing media unfettered into the printing area.

Figure 4:
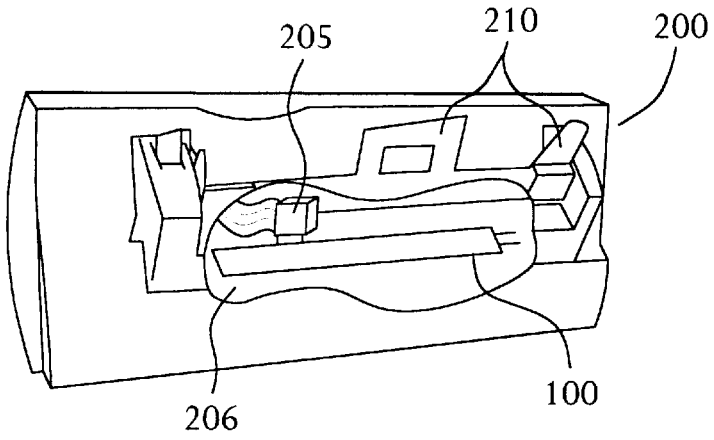
FIG. 4 is a rear perspective view, of a printer, showing in a cut-a-way view, the location of the preferred heating element in the mid-frame of the printer.

Exiting from the lead coupler 18 of the heating element 100 are a pair of power lead pins 14 and 16 and a thermocouple wire pair 20 for making electrical connection. The element 100 is designed to work with a 25 VDC printer power unit operating at a power consumption of about 2–3 amps. It should heat up relatively quickly in about 10–30 seconds. It also desirably contains a polymeric matrix having a coefficient of thermal expansion which is within about 15% of the coefficient of thermal expansion for the polymeric materials of the printer, such as the mid-frame 206 as shown in FIG. 4.

The preferred circuit 22 of the heating element 100 of this invention is illustrated in FIG. 2. The circuit 22 includes a resistance heating material, which is ideally a resistance heating wire 26 wound into a serpentine path containing about 20–51 windings, or, a resistance heating material, such as a foil or printed circuit, or powdered conducting or semi-conducting metals, polymers, graphite, or carbon. More preferably the resistance heating wire 26 includes a NiCr alloy, although certain copper, steel, and stainless-steel alloys could be suitable. Whatever material is selected, it should be electrically conductive, and heat resistant.

With reference to FIG. 3, there is shown in magnified cross section, a preferred detailed construction of a heating element 100 of this invention. The element 100 of this embodiment includes the polymer layer or matrix 113, which is preferably of a high-temperature variety including a melting or degradation temperature of greater than 93° C. (200° F.). High temperature polymers known to resist deformation and melting at operating temperatures of about 75–85° C. are particularly useful for this purpose. Both thermoplastics and thermosetting polymers can be used. Preferred thermoplastic materials include, for example: fluorocarbons, polyaryl-sulphones, polyimides, and polyetheretherkeytones, polyphenylene sulfides, polyether sulphones, and mixtures and co-polymers of these thermoplastics. Preferred thermosetting polymers include epoxies, phenolics, and silicones. Liquid-crystal polymers can also be employed for improving high-temperature use. The most preferred materials for the purposes of the current embodiment of this invention are compression or sheet molding compounds of epoxy reinforced with about 50–60 wt % glass fiber. A variety of commercial epoxies are available which are based on phenol, bisphenol, aromatic diacids, aromatic polyamines and others, for example, Litex 930, available from Quantum Composites, Midland, Mich.

As stated above, the polymeric layers of this invention preferably also include reinforcing fibers, such as glass, carbon, aramid, steel, boron, silicon carbide, polyethylene, polyimide, or graphite fibers. The fibers 112 can be disposed throughout the polymeric material prior to molding or forming the element 100, in single filament, multifilament thread, yarn, roving, non-woven or woven fabric.

In addition to reinforcing fibers, this invention contemplates the use of thermally conducting, preferably non-electrically conducting, additives 110. The thermally-conducting additives 110 desirably include ceramic powder such as, for example, $Al_2O_3$, MgO, $ZrO_2$, Boron nitride, silicon nitride, $Y_2O_3$, SiC, $SiO_2$, $TiO_2$, etc., or a thermoplastic or thermosetting polymer which is more thermally conductive than the "high temperature" polymer suggested to be used with the polymeric coating 113. For example, small amounts of liquid-crystal polymer or polyphenylene sulfide particles can be added to a less expensive base polymer such as epoxy or polyvinyl chloride, to improve thermal conductivity.

In order to support the preferred resistance heating element 100 of this invention, a fibrous supporting layer is desirably employed to hold it in place while the polymeric layer 113 is applied. The fiber supporting layer should allow the polymeric resin of the heating element 100 to flow through its structure so as to encapsulate the preferred resistance heating wire 26 or material. However, it should be resilient enough to allow viscous polymer materials, which contain large amounts of glass fibers and ceramic powder, to pass through its course openings without substantially deforming the circuit 22. It will become apparent to one of ordinary skill in the art that the circuit will employ very fine diameter, i.e., about 0.01–0.1 cm resistance wire, and that compression molding or injection molding, for example, could cause such a dislocation force, that the resistance heating wire 26 could be removed from the pins 24, or be pushed them into the mold wall surface. This could cause unintentional shorts or rejected components.

In the preferred embodiment of this invention, the fibrous support layers comprise resilient nonconducting fibers, such as those made from glass, boron, rayon, Kevlar aramid, or other polymers. More preferably, the supporting layers include a pair of glass mat support layers 114 such as Dura-Glass glass mat from Johns Manville, bonded with adhesive 116 such as polyvinyl acetate, acrylic or silicone, to the resistance heating wire 26 or material. Good examples of adhesives useful for this purpose include 3M 77 and 4550 spray adhesives. Dura-Glass mats are relatively thin, non-woven, fiberglass mats composed of glass filaments oriented in a random pattern, bonded together with a resinous binder, such as modified acrylic.

Operation of Heating Element

Figure 5:
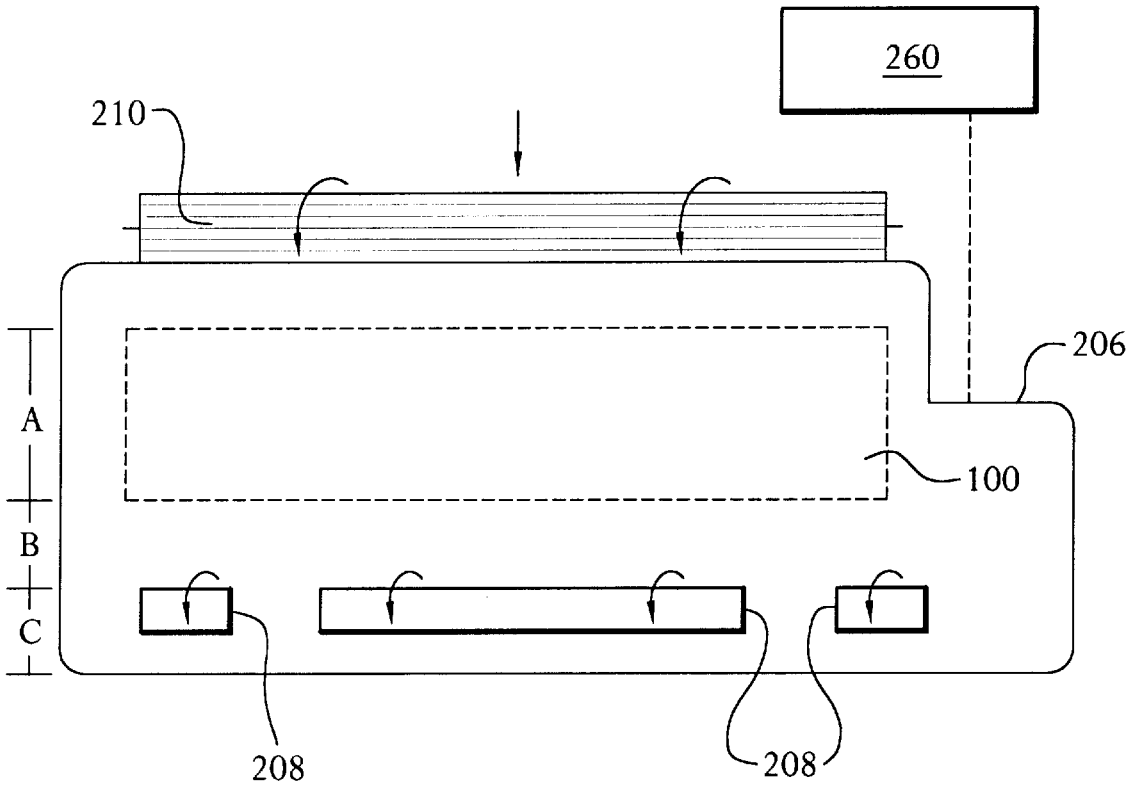
FIG. 5: is a top plan schematic view of the mid-frame portion of the printer of FIG. 4.

With reference to FIGS. 4 and 5, the preferred heating element operation will now be described. The element 100 is designed to be inserted along the media pathway, and preferably adhesively bonded or melt bonded to a polymeric component of the printer 200. More preferably, the element 100 is joined to the midframe 206 of the printer 200 in the region designated as "A" shown is FIG. 5. In this location, the heating element of this invention is a pre-conditioning or pre-heated for print media. The heating element 100 of this invention can be used with ink-jet or laser printers using either solid or liquid inks, in which the paper is loaded from a carriage either from behind or from in front of the printer 200. The heating element 100 is desirably manufactured with a polymeric layer 113 which has a coefficient of thermal expansion which is less than 15% from, and more preferably within about 5% of, the coefficient of thermal expansion of the polymeric material of the media pathway, or midframe 206. In one embodiment, the heating element 100 is co-molded with the midframe, or media pathway portion, to reduce the number of parts in the printer 200.

The heating element 100 is preferably powered from a 25 VDC signal from a power supply which can be modulated by a pulse width modulator to provide a square wave of variable pulse width, thereby allowing the various power settings necessary for operation of the heating element 100. A thermistor, or thermocouple 10, is used to sense the heater temperature. A constant power closed loop control circuit comprising pulse width modulator control functions, variable frequency control functions, and average current measurement and voltage measurement functions, controls the power applied to the heater element 100. The thermocouple 10 sets the initial conditions for the heater warmup.

In response to an initial print command, the heating element 100 in this exemplary embodiment is run at 110 W for about 10–30 seconds to ramp the heater up to operating temperature as quickly as possible. The heater power is then reduced to about 10–80 W, preferably about 10–15 W, for plain paper printing, or about 5–70 W, preferably about 5–10 W, for printing on transparent polyester media, and about 5–32 W, preferably about 5–8 W, for glossy polyester media, depending upon paper speed and heating element size, etc. Once the printer has finished the desired printing output and no other output is requested, the heating element 100 power is reduced to about 5–28 W for a warm idle state.

The print media sheet is advanced at a preferred speed of about 5 inches per second throughout its operation, and the heating element 100 is maintained at a temperature of about 90° C. for paper, or about 95° C. for transparency film. This heats the media sheet to temperatures of about 70° C. to 75° C. Other speeds and temperatures may be suitable for other materials and ink formulations. The media must be sufficiently heated to promote good ink adhesion, but must not be so overheated to reliquefy the ink and blur the image, or to damage the media itself. Considering all possible alternative media and ink formulations currently available, the heating element 100 temperature may acceptably range between about 80° C. and about 150° C., more preferably between about 85° C. and about 105° C., and most preferably between about 90° C. and about 100° C. Faster throughput rates will require higher heating element 100 temperatures to yield a given media temperature.

The length of the active midframe area 206 shown in FIG. 5 is determined in the following manner for this exemplary printer embodiment useful for office paper and envelopes. It will be understood that printers can be any size, depending on the commercial application. The area can be considered to have three regions, the first region is "A", a pre-heat region for preheating the advancing medium before reaching the active print zone. The second region, "B" is the active print zone, i.e., the area shadowed by the print nozzles comprising the printhead 205. In this embodiment, this area is defined by the nozzle coverage of the print cartridges. The third region "C" is a post-print heating region, reached by the medium after being advanced through the active print zone. In this embodiment, the pre-heat region "A" has a length of about 2.54–5.08 cm, preferably about 3.56 cm, and a width of about 15.24–25.4 cm preferably about 22.22 cm. The active print zone region "B" has a length of about 0.76–1.0 cm. The post-print heating region has a length equal to two or three-pass medium advancement distances, or about 0.254–0.76 cm. The three regions aggregate approximately 3.56–6.86 cm in length in this embodiment. It is also understood that the regions could be switched in position, or overlap, whereby the medium can be heated before, during or after printing, or a combination of these.

The controller 260 will now be described. The controller 260 interfaces with a host computer, such as a personal computer or work station, which provides print instructions and print data. The printer 200 further includes media select switches and other operator control switches, which provide means for the operator to indicate the particular type of medium to be loaded into the printer, e.g., plain paper, glossy coated paper or transparencies. Alternatively, the host computer signals may specify the particular type of media for which the printer is to be set up. As described above, the heating element 100 is controlled by a constant power feedback circuit, wherein heater current sensing and voltage sensing is employed to set the heating element 100 drive signals produced by the drive circuit. The drive circuit is in turn controlled by the controller 260. The heating element 100 is driven by the preheater driver circuit from 15–45 VDC, preferably 25 VDC, power supplied by the power supply, and is also controlled in an open loop fashion by the controller 260. The controller 260 accesses data stored in the memory devices which may, for example, define fonts and other parameters of the printer 200.

The manual feed slot and path may be used in the following manner. With the printer 200 in a ready state, a single sheet or envelope is manually fed into the media guides 210 of the manual feed slot. A sensor in the manual feed paper path is activated by the manually fed paper, and the drive roller (not shown) is started rotating as a result. The paper sheet or envelope is fed forward, and the leading edge is recognized by a carriage sensor (now shown). The carriage sensor signal is used by the controller 260 to finely position the paper relative to the print area "B", and to commence printing operations.

Plot instructions are then received by the printer controller 260, typically from the host computer. In the case in which the printer 200 has just been powered up, or in the event of a long time delay since the last print job executed by the printer 200, the controller 260 initiates a warm up procedure to warm up the heating element 100 at a high power level for a warmup interval, e.g., 10–30 seconds in this embodiment. Upon expiration of the warmup interval, the sheet feed operation is commenced by actuating the pick roller 210. A sensor located on the carriage acts as a leading edge sensor to detect the presence of the leading edge of the sheet at the print area. Once the leading edge has reached the print zone, the heating element 100 is turned on at the proper power level for the type of medium loaded into the printer. The heating element 100 is preferably controlled by a pulse width modulating variable frequency, constant power control system. The host computer or printer media select switches determine which media heater power setting is required, i.e. preferably a low watt power setting is used for glossy media, a medium watt power setting is used for transparencies, and a higher watt power setting is used for paper, a control signals indicative of the required nominal power setting are selected by the controller 260.

The controller 260 also receives the temperature sensing signal from a temperature sensing circuit, comprising a thermocouple 10 transmitted to the controller 260 through wire pair 20. The thermocouple 10 in this exemplary embodiment is an Omega thermocouple #GG-E-30 Type E, having a maximum temperature rating of 320° C. The controller 260 reads the thermocouple temperature signal and determines the heating element 100 temperature state. With this information, the controller 260 determines the 110 watts overdrive power time (for paper or transparency) or cool down time (for glossy) for the heater element.

Having determined the heater temperature, and if the media is transparency or paper, the controller 260 will drive the heating element 100 to about 108 to 110 watts, as measured by the current and voltage sensing circuits. The controller adjusts the heater element every 5 seconds while the heater element is at 110 watts. The heater element remains at 110 watts for a minimum of 10–30, preferably about 25 seconds, in this embodiment, or for the time determined by the thermocoupler state. The driving of the heating element 100 will stop if the temperature is indicated at over 85° C. for paper or 80° C. for transparency. This is to prevent the heating element 100 from overheating paper discoloration, and possibly damaging the polymeric component of the heater. After the 110 watt warm-up phase, the heater element power is set to the media printing power for the selected media type. The actual printing power is recalculated once per page. If the heating element 100 has previously been in a higher power state (such as 5–70 watts for transparency, or 10–80 watts for paper), the controller will turn the heater element off (0 watts) and monitor the thermocoupler every 5 seconds for up to a minute. Once the heater element has cooled, the controller 260 will set the heating element 100 power setting to he warm idle state, 5–28 watts. The controller recalculates the heating element 100 power once per page. If the printer 200 has no print jobs for one minute, the controller 260 sets the heating element 100 power level to 5 watts, or less.

After printing is complete, the sheet is ejected by exit roller 208 into the output tray, and the heating element 100 is left "on" for one minute. If another page is to be printed, the plot instructions for that page are obtained from the host computer. If no further pages are to be printed within one minute, the power in the heating element 100 is set to the idle state or turned off.

From the foregoing, it can be realized that this invention provides improved heating elements useful in preconditioning or preheating printing media for printers. The heating elements contain a polymeric material which is thermally conductive, but heat resistant, and which is thermally compatible with the other polymeric components of an ink jet heater, such as to minimize thermal distortion. The heating elements of this invention can be microprocessor controlled to generate different power ratings for different types of media without sacrificing fast warm-up times or uniform heating of a media prior to printing. This invention also contemplates the use of fibrous support layers, such as glass mats, thermally conductive additives and reinforcing loose fibers, for improving manufacturing quality, disbursing radiant and conductive heat, and providing more resistance to thermal distortion for the heating elements during use. Although various embodiments have been illustrated, this is for the purpose of describing, and not limiting the invention. Various modifications, which will become apparent to one skilled in the art, are within the scope of this invention described in the attached claims.

We claim:

1. An ink-jet heater assembly for heating a printing media for an ink-jet printer comprising:

a. an electrical resistance heating member for generating resistance heating when electrically activated;

b. a fibrous support layer disposed over said electrical resistance heating member; and c. a polymeric layer substantially encapsulating said fibrous support layer and said electrical resistance heating member said polymeric layer being integrally formed into a polymeric media pathway component of an ink-jet printer by cross-linking, melt-bonding or adhesive bonding.

2. The ink-jet heater assembly of claim 1 wherein said polymeric media pathway component comprises a portion of a printer mid-frame assembly, carriage or paper tray.

3. The ink-jet heater assembly of claim 1 wherein said fibrous support layer comprises a pair of glass mat layers adhered to a top and bottom surface of said electrical resistance heating member.

4. The ink-jet heater assembly of claim 1 wherein said polymeric layer comprises the same polymer as the polymer within said polymeric media pathway component of said ink-jet printer.

5. The ink-jet heater assembly of claim 4 wherein said polymeric layer comprises a high temperature thermoplastic or thermosetting polymer having a melting or degradation temperature greater than 90° C.

6. The ink-jet heater assembly of claim 4 wherein said polymeric layer and said polymeric media pathway component are molded together to form a unified printer component.

7. The ink-jet heater assembly of claim 1 wherein said fibrous support layer comprises a glass mat having glass fibers joined together with a resinous adhesive.

8. The ink-jet heater assembly of claim 1 comprising a thermostat or thermistor adapted to regulate current through said electrical resistance heating member upon reaching a preselected temperature limit.

9. An ink-jet heater assembly for preconditioning a printing medium in a media pathway of an ink-jet printer, comprising:

a. an electrical resistance heating wire disposed in a substantially planar circuit path;

b. a first glass mat disposed on a top surface of said electrical resistance heating wire;

c. a second glass mat disposed on a bottom surface of said electrical resistance heating wire; and d. a high temperature polymeric layer substantially encapsulating said circuit path and said first and second glass mats; whereby said electrical resistance heating wire, first and second glass mats, high temperature polymeric layer and a polymeric media pathway component of said ink-jet printer are integrally joined to one another by cross-linking, melt-bonding or adhesive bonding.

10. The ink-jet heater assembly of claim 9 having a power rating of about 5–150 W.

11. The ink-jet heater assembly of claim 10 wherein said power rating is adjustable to a range of about 5–80 W for preconditioning said printing media.

12. The ink-jet heater assembly of claim 9 wherein said polymeric layer comprises a melting or degradation temperature greater than 90° C.

13. The ink-jet heater assembly of claim 9 wherein said media pathway component of said ink-jet printer comprises a polymeric material, and said polymeric layer has a coefficient of thermal expansion within about 15% of that for said polymeric material of said media pathway component.

14. The ink-jet heater assembly of claim 9 wherein said polymeric layer comprises an epoxy thermosetting resin.

15. The ink-jet heater assembly of claim 14 wherein said epoxy thermosetting resin comprises glass fibers, and a thermally conductive additive.

16. The method of preconditioning a printing medium, comprising:

a. providing a media pathway containing an electrical resistance heating member self supported by a polymeric layer, said polymeric layer substantially encapsulating a circuit for said electrical resistance heating member, said heating element integrally disposed within said media pathway via cross-linking, melt-bonding or adhesive bonding, and positioned so as to preheat said printing medium prior to printing;

b. printing said preconditioned printing medium with an ink, whereby cockling and ink bleeding are minimized.

17. The method of claim 16 when said electrical resistance heating member comprises an electrical resistance heating wire supported within said fibrous support layer during an application of said polymeric layer.

18. The method of claim 16 wherein said heating member has a power rating of about 5–150 W.

19. A printer heater assembly for heating a print media, comprising an electrical resistance heating member forming a circuit path; temperature control means disposed proximate to said circuit path for selectively regulating electrical current within said electrical resistance heating member; a polymeric layer disposed over and substantially encapsulating said circuit path and temperature control means; said polymeric layer substantially contacting said circuit path and supporting said circuit path to enable thermal transfer between said heating member and said print media, said heating member having a power rating of about 5–150 W, said polymeric layer joined to a polymeric media pathway component of a printer by a molding operation.

20. The ink-jet heater assembly of claim 19, wherein said polymeric layer comprises a thermally conductive, non-electrically conductive additive for helping to distribute heat generated by said heating element more uniformly across its surface area.

21. Ink-jet heater assembly of claim 19 wherein said polymeric layer and said polymeric media pathway component comprise the same polymer.

* * * * *